US006990687B2

(12) United States Patent
Snedeker et al.

(10) Patent No.: US 6,990,687 B2
(45) Date of Patent: Jan. 31, 2006

(54) FIRE PROTECTIVE TROUSERS WITH BELT CLOSURE SYSTEM

(75) Inventors: Julie Snedeker, Northwood, NH (US); Mark Mordecai, Hampton, NH (US)

(73) Assignee: Globe Manufacturing Co., Pittsfield, NH (US)

( * ) Notice: Subject to any disclaimer, the term of this patent is extended or adjusted under 35 U.S.C. 154(b) by 0 days.

(21) Appl. No.: 10/817,909

(22) Filed: Apr. 6, 2004

(65) Prior Publication Data

US 2005/0223462 A1 Oct. 13, 2005

(51) Int. Cl.
*A41D 1/06* (2006.01)

(52) U.S. Cl. ..... 2/79

(58) Field of Classification Search ..... 2/458, 2/7, 8, 22, 23, 81, 69.5, 76, 79, 80, 82, 227, 2/235, 236, 237, 336, 338, 919
See application file for complete search history.

(56) References Cited

U.S. PATENT DOCUMENTS

| | | | | |
|---|---|---|---|---|
| 2,583,992 | A * | 1/1952 | Bouteloup | 2/237 |
| 3,784,986 | A * | 1/1974 | Klaproth | 2/237 |
| 3,852,824 | A * | 12/1974 | Grey | 2/79 |
| 4,941,209 | A * | 7/1990 | George | 2/79 |
| 5,896,859 | A * | 4/1999 | Carroll | 128/845 |
| 6,829,786 | B2 * | 12/2004 | Ellis | 2/235 |

* cited by examiner

*Primary Examiner*—Gary L. Welch
(74) *Attorney, Agent, or Firm*—Dykema Gossett PLLC

(57) ABSTRACT

Fire protective trousers for use by firefighters, emergency responders and rescue workers includes an outer shell that can mount a removable liner therein and a belt closure system, the outer shell defining a belting area and the belt closure system including right and left sheaths that respectively extend from the right rear to the right front and from the left rear to the left front of the trousers and through which extend respective right and left belt sections whose rear ends are attached to the outer shell and whose front ends are attached to the respective right and left parts of a snap buckle that can be easily attached or disconnected by a wearer even if wearing gloves.

18 Claims, 2 Drawing Sheets

FIRE PROTECTIVE TROUSERS WITH BELT CLOSURE SYSTEM

BACKGROUND OF THE INVENTION

1. Field of the Invention

The present invention relates to fire protective clothing, and in particular to fire protective trousers worn by firefighters, emergency responders and rescue workers.

2. The Prior Art

Fire protective trousers for use by firefighters, emergency responders, rescue workers, etc., are conventionally formed of an outer shell that is made of a fire protective material and a removable liner that is itself formed of an outer layer of a moisture barrier material and an inner layer of a thermal material, these layers being stitched together along their peripheries. The outer shell includes fastening means for attachment of the liner therein. In order to position the trousers on a wearer, it can include buttons or other means for attachment of suspenders, or it can include belt loops spaced around its waist area through which a belt can be extended, or it can include an elastic band that extends peripherally around its waist area. The use of a belt provides a fixed circumference to the trousers and thus a desired tight fitting around the waist of a wearer. The use of an elastic band provides for a flexible fit around the waist of a wearer and thus accommodates bending and sitting movements of the wearer. However, neither attachment means is ideal since the use of a belt does not accommodate bending and sitting of the wearer and the use of an elastic band may not provide sufficient tightness around the waist of the wearer.

A need exists for a belting system in fire protective trousers that accommodates varying waist sizes of wearers yet provides a degree of flexure in the waist area to accommodate bending and sitting.

SUMMARY OF THE INVENTION

According to this invention, a pair of fire protective trousers includes an outer shell that has a belt closure system that includes an elastic band that is attached to the outer shell around a rear portion thereof, right and left belt guides connected to the outer shell, and right and left belt sections that are respectively connected at rear ends to the outer shell and extend through the respective right and left belt guides to front ends that connect with right and left snap buckle parts, these snap buckle parts being engagable to fixedly position the trousers on a wearer and provide a positive closure for a fly flap at the front of the trousers, while the elastic band along its back portion provides a degree of flexure that accommodates bending and sitting of the wearer. One of the belt sections can be adjustably connected to the associated buckle part to enable adjustment to the waist size of the wearer. The use of a snap buckle enables easy attachment and detachment of the belt sections even when the wearer is wearing gloves.

Further features and advantages of the invention will be understood by reference to the attached drawings, taken in conjunction with the following discussion.

DETAILED DESCRIPTION OF THE PREFERRED EMBODIMENTS

Figure 1:
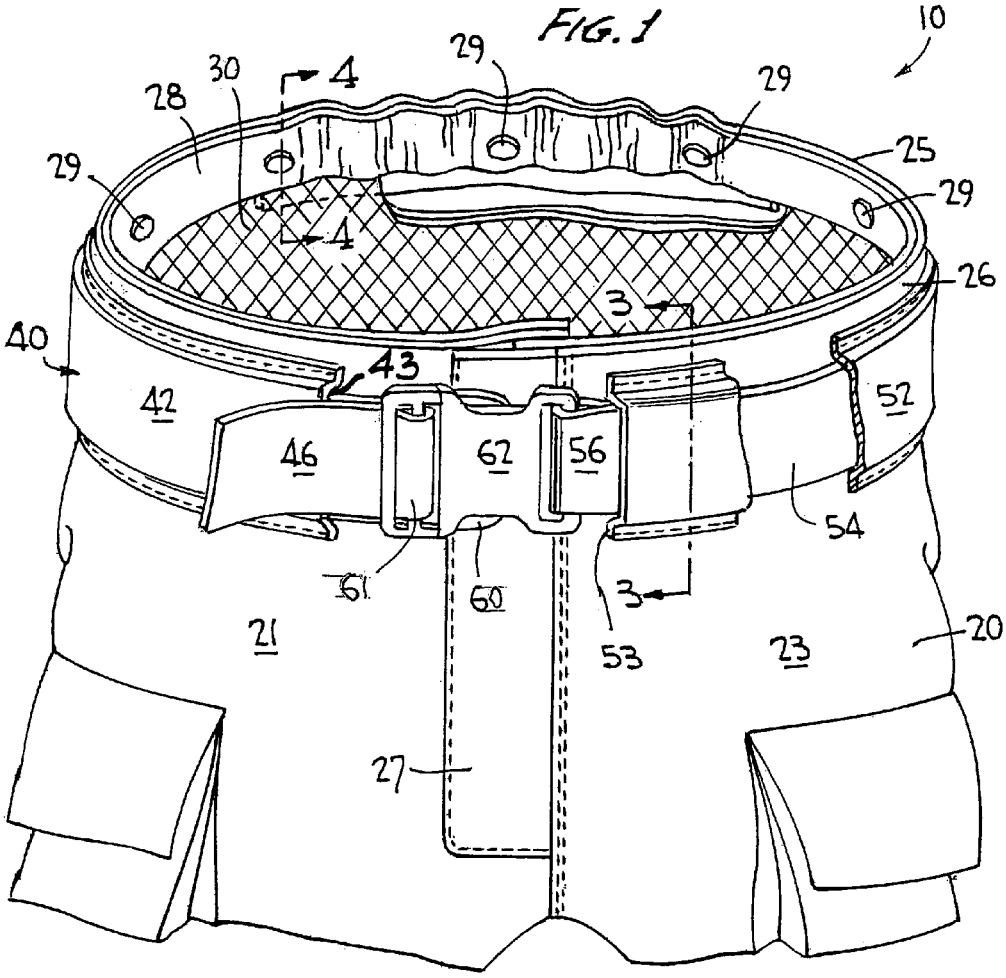
FIG. 1 is a front view of an upper portion of a pair of fire protective trousers that includes a belt closure system according to a preferred embodiment of the present invention.
Figure 2:
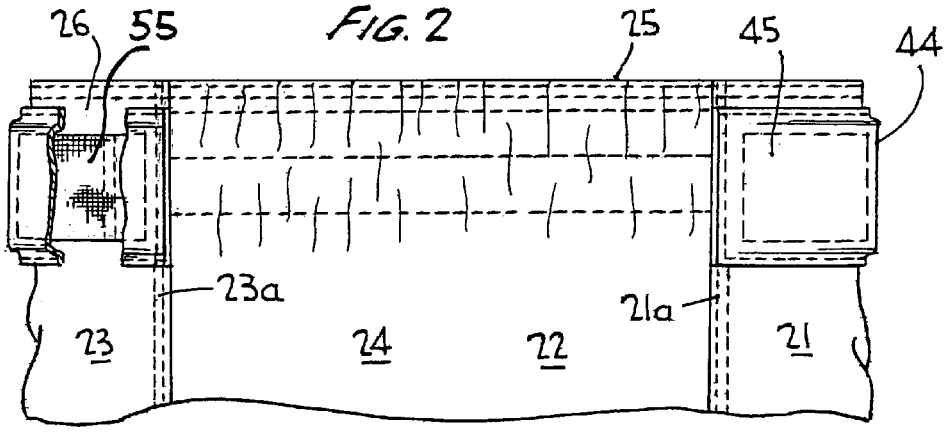
FIG. 2 is a rear view of the fire protective trousers of FIG. 1.

FIGS. 1 and 2 show an upper of a pair of fire protective trousers that include a belt closure system according to this invention. The trousers, generally labeled 10, include an outer shell 20 and a removable liner 30. The belt closure system is generally labeled 40 in FIG. 1.

The outer shell 20, which is made of a flame resistant material such as NOMEX® fabric, includes a right front panel 21, a right rear panel 22, a left front panel 23 and a left rear panel 24. As can be seen in FIG. 2, the right front panel 21 extends laterally behind the right side of the trousers so that the generally vertical seam 21*a* that connects the right front panel 21 to the right rear panel 22 is located in the right rear area of the trousers. Likewise, the left front panel 23 extends laterally behind the left side of the trousers so that the generally vertical seam 23*a* that connects the left front panel 23 to the left rear panel 24 is located in the left rear area of the trousers. The upper edge of the trousers is labeled 25, and below this upper edge is a belting area 26 that extends around the periphery of the trousers. A fly covering flap 27 attached to the left front panel 23 can be connected to the front of the right front panel 21 by suitable fastening means, e.g., hook and loop fasteners, to cover the fly between these panels, e.g., a zipper, buttons or other fastening elements (not shown).

A waistband 28 is attached to the inside of the upper edge 25 of the outer shell to hang downwardly within the outer shell, this waistband including inwardly directed snap sockets 29 at spaced locations around its periphery. The waistband 28 includes a layer 28*a* of moisture barrier material and a layer 28*b* of a thermal material.

Figure 3:
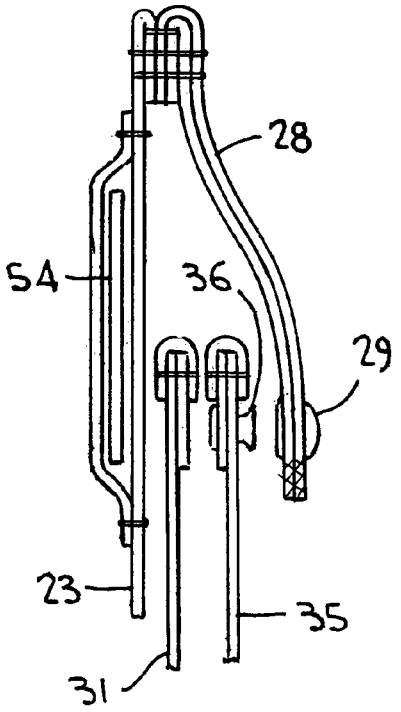
FIG. 3 is a cross section through the fire protective trousers as seen along line 3—3 in FIG. 1.
Figure 4:
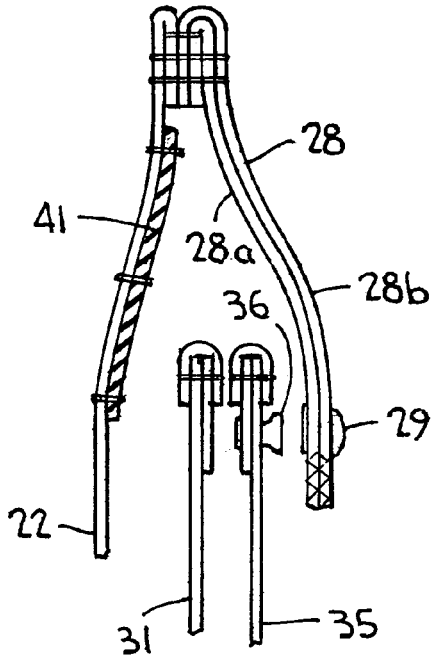
FIG. 4 is a cross section through the fire protective trousers as seen along line 4—4 in FIG. 1.

As can be seen in FIGS. 3 and 4, the liner 30 includes an outer layer 31 of moisture barrier material and an inner layer 35 of thermal material. The inner layer 35 includes outwardly-directed snap studs 36 at spaced locations around its periphery for attachment to the snap sockets 29 on the waistband 28. The upper ends of the inner layer 35 and the outer layer 31 are otherwise detachably connected by fastening means such as interengagable snap sockets and snap studs (not shown) at spaced locations around their peripheries. Those locations are preferably intermediate the locations of the snap studs 36 on the inner layer 35.

Figure 5:
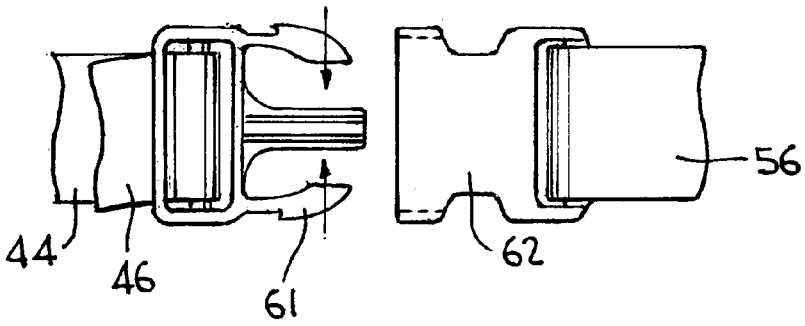
FIG. 5 is a front view of the snap buckle of the belt closure system.

The belt closure system 40 of the invention include various elements on the belting area 26 of the outer shell 20 to enhance fitting and tightening the trousers around the waist of a wearer. As seen in FIGS. 1, 2 and 4, an elastic band 41 is attached (sewn) to the inside surface of the back portion of the outer shell 20 along its belting area 26 between the seams 21*a* and 23*a* to provide a flexible enclosure area that can accommodate movements of the wearer such as torso bending which occurs regularly during use. A right belt guide in the form of a sheath 42 is connected (sewn) to the outer side of the outer shell 20 along its belting area 26 so as to extend from the seam 21*a* to a mouth 43 near the fly covering flap 27 at the front of the trousers. A right belt section 44 extends through the right sheath 42 from a rear end 45 that is sewn to the outer shell to a front end 46 that extends freely beyond the mouth 43. This front end 46 is adjustably threaded through a first part 61 of a snap buckle 60 (see FIG. 5). Likewise, a left belt guide in the form of a sheath 52 is connected (sewn) to the outer side of the outer shell 20 along its belting area 26 so as to extend from the seam 23*a* to mouth 53 near the closure flap 27 at the front of the trousers. A left belt section 54 extends through the left sheath 52 from a rear end 55 that is sewn to the outer shell to a front end 56 that extends freely beyond the mouth 53. This front end 56 is fixedly connected to a second part 62 of the snap buckle 60. The first and second parts 61, 62 of the snap buckle 60 can be connected to fixedly mount the trousers around the waist of a wearer and to provide a positive closure over the fly covering flap 27, or be disconnected for easy removal of the trousers even when the wearer may be wearing gloves. The sheaths 42 and 52 are made of a flame protective material such a NOMEX® fabric so as to protect the portions of belt sections 44 and 54 therein from environmental exposure. The belt sections 44 and 54 are made of a durable and flame resistant material such a NOMEX® webbing.

While a preferred embodiment of the invention has been described in detail, modifications therein can be made and still fall within the scope of the appended claims. For example, the sheaths 42 and 52 can be replaced by one or more loops that are located between the rear and front ends of the respective belt section that extend therethrough. In addition, the belt sections 44 and 54 can respectively include at least one elasticized portion, if desired, to provide additional flexibility in the waist area of the trousers when the snap buckle 60 is closed.

We claim:

1. Fire protective trousers comprising an outer shell and a belt closure system, said outer shell including a front portion and a rear portion and defining a belting area beneath an upper edge thereof, said belt closure system including a right belt guide attached to the outer shell, a right belt section having a rear end which is fixedly connected to the outer shell and which extends through the right belt guide to a free front end, a left belt guide attached to the outer shell, a left belt section having a rear end which is fixedly connected to the outer shell and which extends through the left belt guide to a free front end, and a snap buckle that includes a right part and a left part, said free end of the right belt section being attached to the right buckle part and the left belt section being attached to the left buckle part.

2. Fire protective trousers according to claim 1, wherein a first of said right and left belt sections is fixedly attached to a respective right and left buckle part.

3. Fire protective trousers according to claim 1, wherein a second of said right and left belt sections is adjustably attached to a respective buckle part.

4. Fire protective trousers according to claim 1, wherein rear ends of said right and left belt sections are stitched to the outer shell.

5. Fire protective trousers according to claim 1, wherein said right and left belt guides are sheaths which are stitched around their peripheries to said outer shell except for mouths at the front of the outer shell.

6. Fire protective trousers according to claim 5, including an elastic band attached to the rear portion of the trousers along the belting area thereof.

7. Fire protective trousers according to claim 6, wherein said elastic band extends between rear ends of said right and left sheaths.

8. Fire protective trousers according to claim 1, wherein said outer shell includes a right front panel, a right rear panel, a left front panel and a left rear panel, said right front panel being connected to said right rear-panel along a generally vertical seam at the right rear portion of the trousers and the left front panel being connected to the left rear panel along a generally vertical seam at the left rear portion of the trousers.

9. Fire protective trousers according to claim 1, wherein said outer shell includes a waistband attached thereto to hang inwardly thereof.

10. Fire protective trousers according to claim 9, wherein said waistband comprises a first moisture barrier layer and a second thermal layer.

11. Fire protective trousers according to claim 9, wherein said waistband includes inwardly-directed fastening means for attachment of a removable liner thereto.

12. Fire protective trousers according to claim 11, wherein said inwardly-directed fastening means comprise spaced fasteners.

13. Fire protective trousers according to claim 12, wherein said spaced fasteners are selected from snap studs and snap sockets.

14. Fire protective trousers according to claim 13, wherein said removable liner includes an outer layer of a moisture barrier material and an inner layer of a thermal material.

15. Fire protective trousers according to claim 14, wherein said outer layer includes outwardly directed first fastening means for attachment to said inwardly-directed fastening means on said waistband.

16. Fire protective trousers according to claim 15, wherein said inner and outer layers include second fastening means for connected said layers together at upper ends thereof.

17. Fire protective trousers according to claim 16, wherein said second fastening means include snap studs and snap sockets located intermediate said first fastening means.

18. Fire protective trousers according to claim 1, wherein said right and left belt guides respectively comprise at least one belt loop located between said rear and front ends of said respective right and left belt sections.

* * * * *